US005228141A

United States Patent [19]

Remsky et al.

[11] Patent Number: 5,228,141

[45] Date of Patent: Jul. 20, 1993

[54] PATIENT WEARING APPAREL

[75] Inventors: Gregory W. Remsky; William S. Remsky; Mary M. Remsky, all of Boca Raton, Fla.

[73] Assignee: Remedco Inc., Boca Raton, Fla.

[21] Appl. No.: 872,559

[22] Filed: Apr. 23, 1992

[51] Int. Cl.[5] ..... A41D 13/00

[52] U.S. Cl. ..... 2/114; 2/DIG. 7

[58] Field of Search ..... 2/46, 48, 49 R, 50, 2/51, 69, 74, 75, 88, 104, 105, 106, 114, 115, 240, 268; 450/86, 109, 110, 112

[56] References Cited

U.S. PATENT DOCUMENTS

| | | | |
|---|---|---|---|
| 2,528,340 | 10/1950 | Coven | 2/114 |
| 3,116,491 | 1/1964 | Previdi et al. | 2/114 X |
| 3,160,891 | 12/1964 | MacDonald | 2/DIG. 7 X |
| 3,276,036 | 10/1966 | Cater | 2/114 |
| 3,343,537 | 9/1967 | Graham | 2/114 |
| 3,353,189 | 11/1967 | Zimmon | 2/114 |
| 3,464,063 | 9/1969 | Hoegerman | 2/114 |
| 3,496,944 | 2/1970 | Cuozzi | 450/112 X |
| 3,503,078 | 3/1970 | Gallian | 2/240 |
| 3,874,001 | 4/1975 | Patience et al. | 2/240 |
| 4,570,268 | 2/1986 | Freeman | 2/DIG. 7 |
| 4,718,124 | 1/1988 | Sawicki et al. | 2/114 |
| 4,759,083 | 7/1988 | Belcher | 2/114 |
| 4,920,578 | 5/1990 | Janzen et al. | 2/114 |
| 4,945,576 | 8/1990 | Melton | 2/268 |
| 4,964,173 | 10/1990 | Gordon et al. | 2/114 |
| 5,050,243 | 9/1991 | Udell | 2/114 |

*Primary Examiner*—Clifford D. Crowder
*Assistant Examiner*—Jeanette E. Chapman
*Attorney, Agent, or Firm*—John H. Faro

[57] ABSTRACT

A unitary wraparound, one-piece back, medical patient garment provides openable connections between the back panel and each of the front panels, the connections being below the shoulder of the person wearing the garment. A two element threaded tie secures the gown around the waist of the person wearing the gown. Connections between the front panels and the back panel may be opened selectively, exposing selected body parts of the person wearing the gown, without unduly exposing other body parts of the person.

2 Claims, 4 Drawing Sheets

FIG. 9
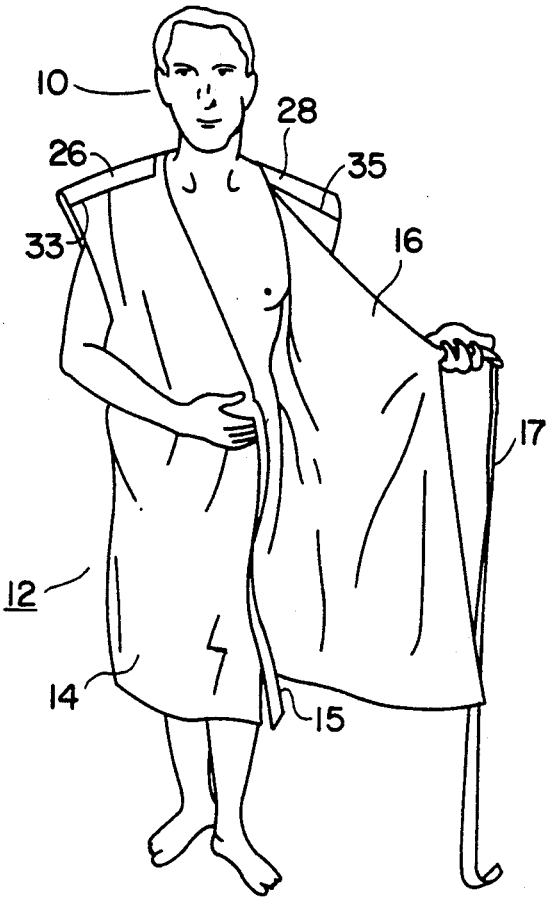
FIG. 10
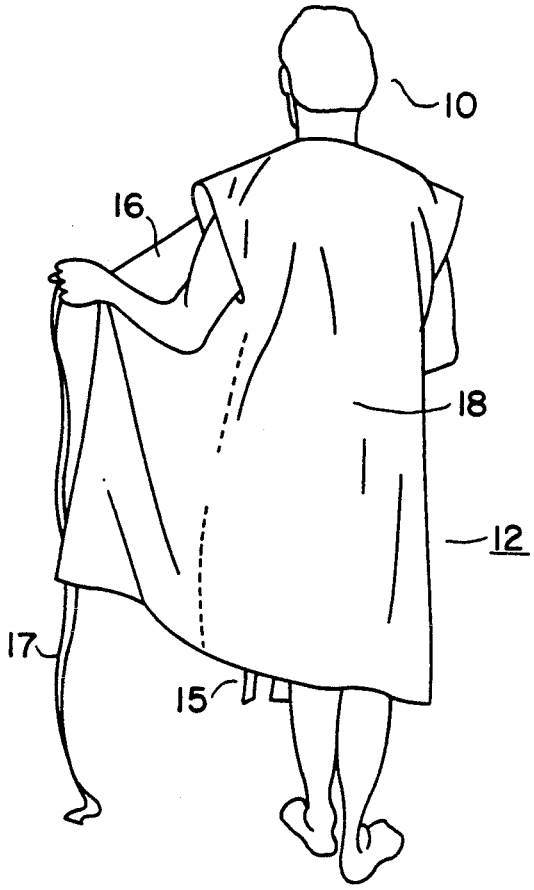
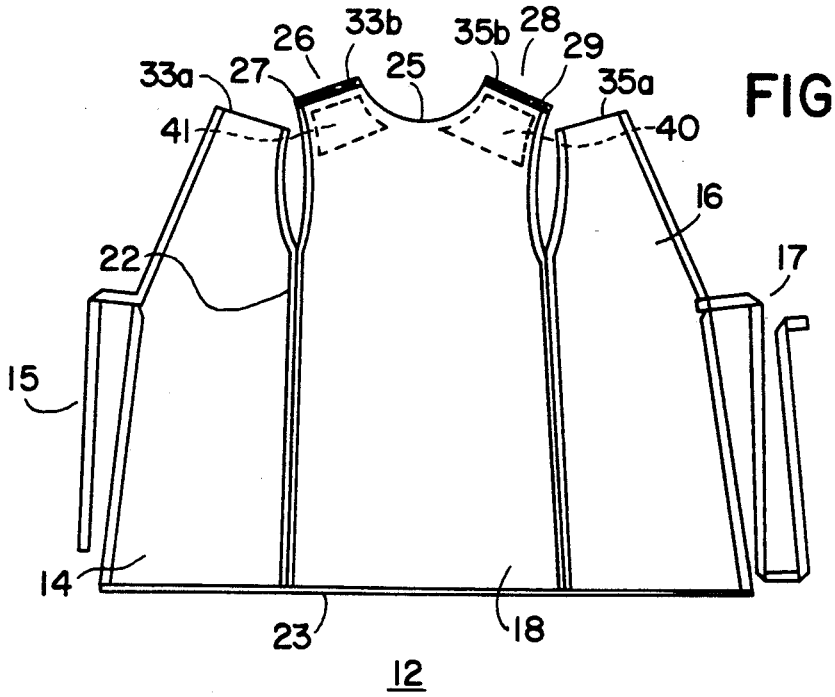
FIG. 11

PATIENT WEARING APPAREL

BACKGROUND OF THE INVENTION

1. Field of the Invention

The present invention relates to wearing apparel for medical patients. More particularly, the invention relates to garments or wearing apparel of the type intended for use by, without limitation, medical patients while going through one or more various medical diagnostic procedures involving examination, by medical personnel, of the upper part of the body.

2. Prior Art

Hospital and/or medical patient gowns have been designed, for the most part, for convenience of the medical community, rather than patient convenience and comfort. Although substantial advancement has been made in the art relating to medical patient attire, the advance in medical science, medical procedures and medical techniques has overshadowed and outdistanced the advancement in medical patient wearing attire or apparel.

One of the reasons for the lag in the development and/or advancement of new and/or advanced medical patient attire is that medical procedures, when first used on patients, are often not standardized because early techniques used to perform a particular medical procedure are usually developed and designed for the benefit and/or convenience of the medical community rather than the convenience and/or comfort of the patient on whom the procedure is practiced.

Another reason for the lag in the development and/or advancement of medical patient wearing attire is that much of the new development is made by the patient or former patient who, after having gone through a particular medical procedure and having been made uncomfortable and/or embarrassed by the required wearing of uncomfortable and/or embarrassing hospital attire, designs and/or develops new wearing attire for use by medical patients who shall go through the same or similar medical procedures.

A much used and well known hospital patient wearing attire is the open back, closed front, short sleeve hospital gown. This solid front panel garment, which is secured by closing the open back with ties, appears to have been designed for hospital staff convenience without consideration for patient comfort or vanity. Although this much used hospital gown is convenient for performing some medical procedures by the medical community, the gown is not convenient or appropriate for some more advanced medical procedures, particularly those medical procedures that involve the shoulders and/or chest area of the body. A modification of this well known patient attire is taught by Janzen et al., in U.S. Pat. No. 4,920,578. Janzen, et al. teaches a modification of the open back hospital gown with selectively openable upper front panels, which open from the neck across the shoulder and along the full sleeve to the arm pit area of the gown. The undesirable and embarrassing short, open back features of the typical hospital gown are retained in the invention, which completely overlooks patient comfort and convenience in the gown that is designed for the convenience of the medical community.

OBJECTS OF THE INVENTION

It is the principle object of this invention to remedy the above, as well as related, deficiencies in the prior art.

More specifically, it is an object of the invention to provide a garment for medical patients that is both patient considerate and medical personnel considerate and accords unrestricted selective access to the upper anterior and upper posterior parts of the body for medical examination and/or procedures.

Another object is to provide a stylish and comfortable garment for a medical patient that provides for limited, selective access to the body of the wearer and preserves patient dignity by maintaining coverage and security for the remainder of the body of the patient wearing the garment.

A further object is to provide a unitary medical patient garment, of wraparound construction having a one-piece back and selectively openable bodice halves, each of which are openable at convenient, off-the-shoulder locations by the wearer of the gown, with shoulder coverage retained when a bodice portion of the garment is opened.

A still further object of the invention is to provide wearing apparel for a medical patient which is of unitary construction having fixed seams and temporarily closable shoulder seams which are easily openable and are opaque for radiographic examination purposes.

These and other objectives of the invention will become apparent when reading the disclosure with reference to the drawings.

SUMMARY OF THE INVENTION

The present invention is an advancement in the art of medical patient wearing attire which provides a garment for medical patients which is comfortable for the patient, patient convenience, stylish and provides for an enhanced degree of personal modesty absent in other hospital and other medical patient wearing attire. The novel medical patient garment is medical personnel convenient, particularly for medical procedures which involve the shoulders and chest area of the body. The garment permits quick and easy partial or limited disrobing of the wearer, when required by medical personnel for examination purposes, while retaining wanted coverage of the wearer/patient so as to avoid embarrassment due to unwanted, unavoidable exposure of the body of the person wearing the garment. The garment permits unrestricted radiological diagnostic procedures accorded the patient wearing the garment, for upper and lower areas of the body, including those special procedures of mammography, ultrasound, CT, MRI, bone densitometry and stereotactics, for example. The characteristics of the gown will permit a mother using the gown to conveniently expose herself to the babe for breast feeding, without unnecessarily removing part of the garment wanted for personal comfort.

The comfort and security of an open front, one-piece back garment is provided in cap sleeved, wraparound design which is secured at the waist of the wearer by a threaded tie or belt attached to the garment. The cap sleeves which have a reinforced appearance, are formed by an over-the-shoulder extension of the one-piece back. Each shoulder panel of the gown conveniently separates, just below the collar bone, permitting either the left side bodice or the right side bodice, or the full bodice of the gown, to be opened, exposing the chest of the wearer, to the degree desired. If only one side of the bodice is opened, the other side of the bodice remains secured and closed, covering the unexposed portion of the chest, in comfort.

The over-the-shoulder extension of the back panel, when separated from the end of the bodice to which the extension is attached, remains on the shoulder so that the back of the gown does not fall, keeping the back fully covered. The over-the-shoulder extension of the back panel may be removed from the shoulder, if desired, to expose the back of the person wearing the gown.

The open back, which is the most common cause of patient wearer discomfort, is avoided in favor of a closed, one-piece back. The short unsightly sleeves, typical of prior art hospital gowns, have been replaced by stylish cap sleeves. A more convenient, wraparound, belt tied gown provides a stylish and functional garment which is easy for a person to get into and convenient to secure about his person. The convenient and selective patient operated, take-down gown front, with shoulder coverage retention, provides patient security and comfort, keeping bodily exposure to a minimum. The convenient and dependable gown connected waist tie retains the garment about the waist of the wearer comfortably, even though the upper portion of the gown has been completely opened and removed from the body. The person wearing the garment is not required to assist in retaining the gown on his persons since the gown is self-retaining on the person of the wearer.

The wraparound, threaded tie garment is conveniently adjustable to a patient's girth so that gown size is a minimal problem. Retention of the gown over the shoulders of the wearer, provides a feeling of garment dependability and personal comfort, security and warmth.

Preferably the novel gown is fabricated from a durable fabric although the invention may be made of paper, if desired.

Three pattern panels are secured together by sewing, for example, providing a unitary garment. The back panel includes two extensions, each of which extend over the left and right shoulders, respectively, of the wearer, the ends of which couple with the right bodice half and left bodice half, respectively, of the front of the garment. Preferably VELCRO fastener pads are used to secure the extensions of the back panel to the bodice portions of the gown front although other fastening or securing means, such as snaps, hook and eye, zipper, tie or other fasteners or connectors may be used, if desired. One may practice the invention using a paper material for making a disposable garment. When using paper material, a paper compatible, separatable adhesive may be used on the separatable closures, if desired.

Both front panels, at their outside edge, have ties or belts secured to the panel at about the same level or position above the hem. One of the front panels, where it is secured to the back panel, has a thread hole in the seam, the hole being at approximately the same level above the hem as the belt or tie connections are above the hem. The thread hole in the seam line is used to receive and pass a tie through the gown so that the ties may be conveniently tied outside the gown at the side of the person wearing the gown.

BRIEF DESCRIPTION OF THE DRAWINGS

FIG. 9, is a front pictorial view of FIG. 1 with the left side of the gown open;

FIG. 10 is a back pictorial view of FIG. 9; and FIG. 11 is a plan view of the inside of the invention.

DETAILED DESCRIPTION OF THE INVENTION INCLUDING PREFERRED EMBODIMENTS

Figure 3:
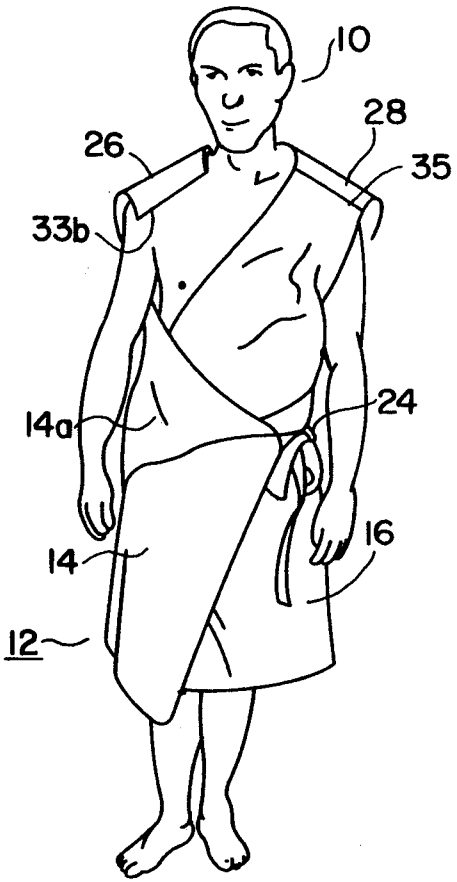
FIG. 3, is a front pictorial view of FIG. 1 with the right side bodice open.
Figure 2:
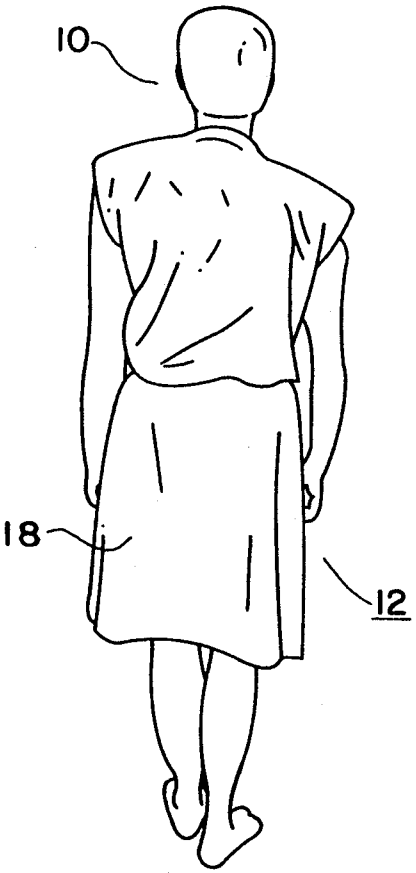
FIG. 2, is a back pictorial view of FIG. 1.

Referring to the drawings in general, throughout the description thereof, identical components represented in the drawings are identified with the use of identical reference numerals.

Figure 1:
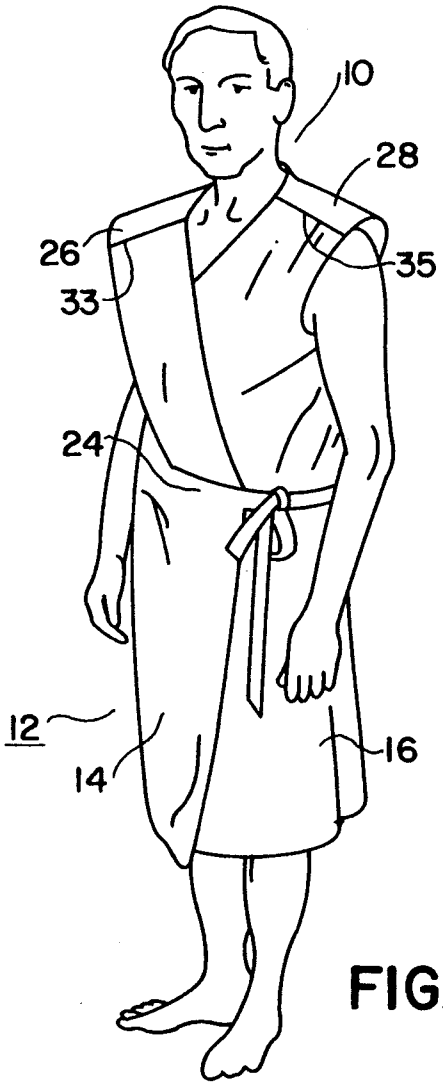
FIG. 1, is a front pictorial representation of a person wearing the invention.

The FIGS. 1 through 7, 9 and 10 represent the gown of the invention, pictorially, worn by a man who is fictional. FIG. 1 is a representation of a person (10) wearing the gown of the invention tied about the waist and secured to his person.

Figure 8:
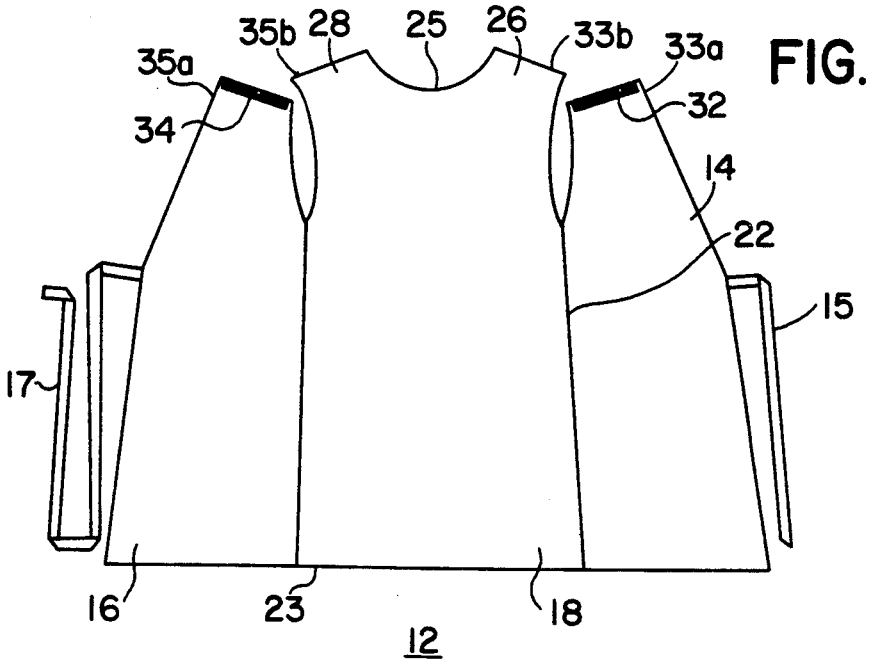
FIG. 8, is a plan view of the outside of the invention.

The wraparound garment (12) includes a front outside panel (14) and a front inside panel (16) with ties (15) and (17) connected to the front panels, respectively. The ties (15) and (17), and their respective connections to the front panels (14) and (16) are more clearly shown in FIGS. 8 and 10.

Figure 6:
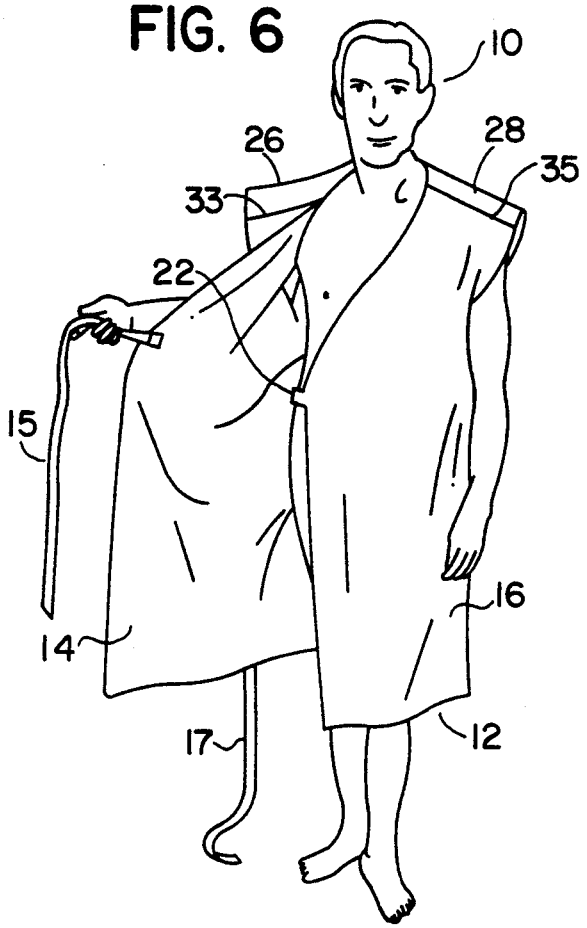
FIG. 6, is a front pictorial view of FIG. 1 with the right side of the gown open.
Figure 7:
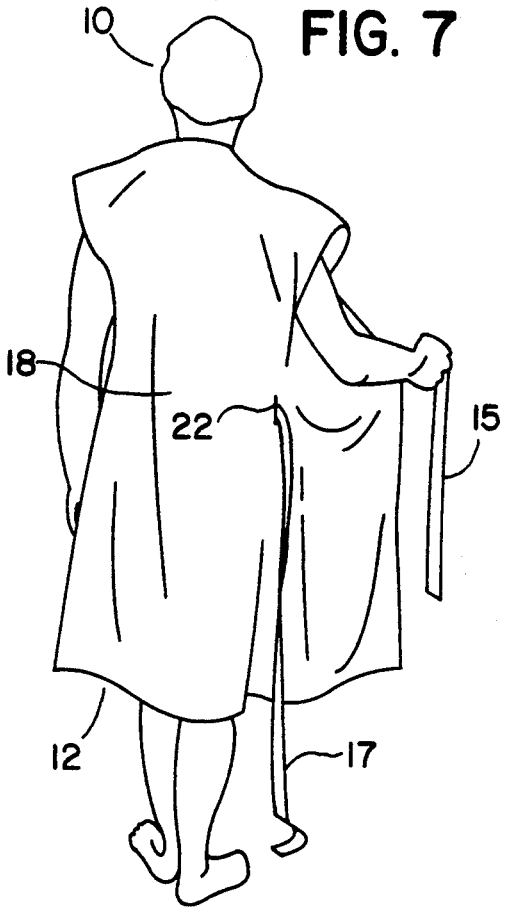
FIG. 7, is a back pictorial view of FIG. 6.

The garment is of unitary construction, comprising three panels; two side panels (14) and (16) and one one-piece back panel (18). Adjacent edges of the panel (14) and the one-piece back (18) are secured together from the hem (23) to the arm pit of the gown, by stitching, for example. A tie threading hole (22) is fashioned in this seam at about the same level from the hem (23) as the ties (15) and (17) are secured above the hem (23) at the front panels (14) and (16). Adjacent edges of the front panel (16) and the back panel (18) are also secured together, for example, by stitching, from the hem (13) to the arm pit of the gown. As seen in FIGS. 6 and 7, the tie (17) is threaded through the hole (22) and is passed through the garment so that the first stage of adjustable fitting and gown tie-on may be accomplished. The tie (17) being passed through the thread hole (22), is then pulled around the back of the waist, outside the back panel of the garment, fashioning a belt. The ties (15) and (17) are knotted external to the gown, at the side of the wearer at (24) providing security for the gown and according adjustable fit and wearer comfort.

The one-piece back panel (18) is extended above the neck opening area (23), forming over-the-shoulder extensions (26) and (28). Along the edge of each extension (26) and (28) is the element of a two element securing system, or fastening means (27) and (29) respectively. The two element securing system or fastening means is preferably a pressure sensitive fastener such as a VELCRO pad and hook fastener, for example. Snaps may also be used, if desired, and, in lieu of a pressure sensitive fastener, other fasteners may be used, such as hook and eyes, ties, zippers or other fasteners, if desired. The pad means (27), for example, on extension (26) and (29) on extension (28), of a two element pressure sensitive fastener means, may be secured at the inside edge of the extensions of the back panel and a hook means, for example at (32) on the upper edge of front panel (14) and (34), on the upper edge of the front panel (16) are used to connect and close the garment at (33) and (35), respectively.

Figure 4:
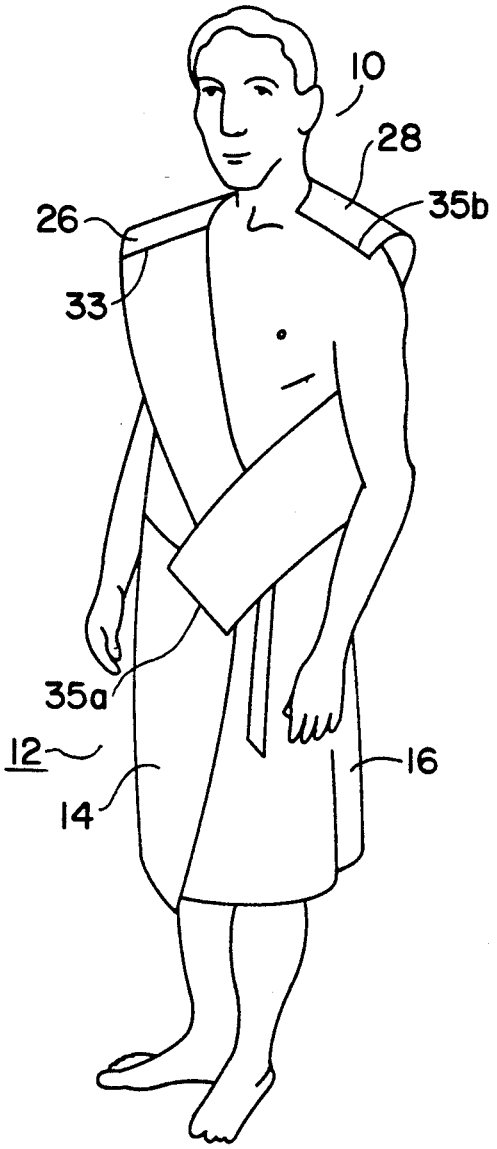
FIG. 4, is a front pictorial view of FIG. 1 with the left side bodice open.
Figure 5:
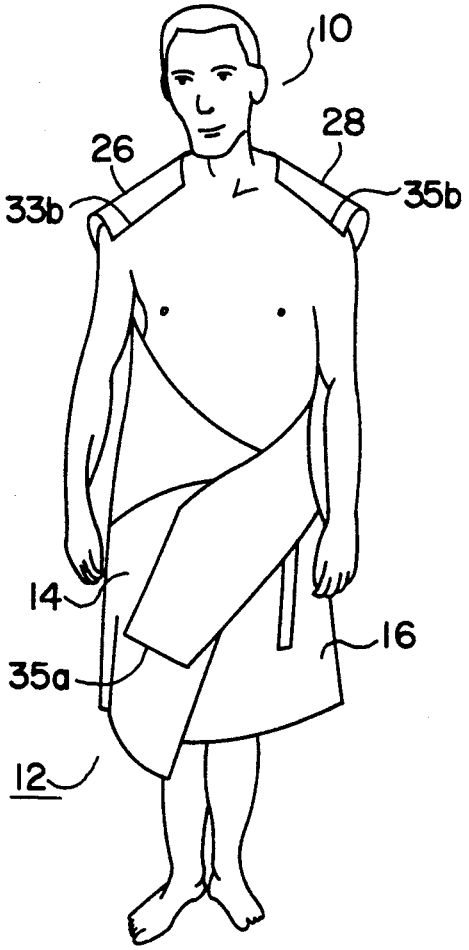
FIG. 5, is a front pictorial view of FIG. 1 with the full bodice open.

The fastening means connecting the panel ends may be separated and, as seen in FIGS. 3, 4 and 5, the upper portion of the front panel, for example (14*a*), may be separated from the back panel extension, to which it is connected, causing the front panel to open, essentially to the waist, exposing, for example, the right side of the chest. The upper portion of the front panel (16) may likewise be separated at (35) for example, and the front panel (16) may be opened, exposing the left side of the chest. With both front panels separated from their respective connections, the entire chest may be exposed. This full exposure is represented in FIG. 5. However, when only one of the front panels is separated from a back panel extension to which it is connected, the unseparated front panel remains connected, covering the person of the wearer as represented in FIGS. 3 and 4. It will be noted, however, that when an extension of the back panel, such as (26) in FIG. 3, for example, is separated from the upper portion of the companion front panel, such as (14*a*) for example, the extension portion (26) (and/or 28) remains on the shoulder, keeping the shoulder and back of the person covered, providing limited body exposure, comfort, warmth and reduces unnecessary embarrassment by unnecessary exposure. When the upper portion of either or both front panels are open, loss of control of the gown by the wearer does not occur because the back of the gown is retained in place by the over-the-shoulder extensions (26) and/or (28) and the gown itself is retained around the waist by the ties (15) and (17), having been secured by a knot, for example (24).

In providing the over-the-shoulder extensions (26) and (28) of the back panel (18), fashionable cap-sleeves, covering each shoulder is provided. This provides a more fashionable looking garment with full and unrestricted openings for outer shoulders and the upper arms.

Preferably the gown is fashioned from a cloth material that is washable making the gown reusable. The ties are sewn on to respective side panel and reinforced with a bar tack or other type of reinforcing stitch.

It may be desirable to use a paper material for the gown thus making a disposable garment. When using a paper material to practice the invention the seams may be sewn or glued together, the openable or separatable closures or seams may be secured using an adhesive compatible with paper, that is separatable and reclosable, such adhesives being available on the open market.

When practicing the invention, any material usually used for making a garment may be used for the gown. However, some materials characteristically are slippery against human skin, such as nylon or silk, for example. If such slippery materials are used it may be desirable to line the inside surface of the extensions with a material which has non-slip characteristics, such as cotton, for example, so that retention of the extension portions of the back panel are assured. This is represented in FIG. 11 by the broken line liners (40) and (41).

A novel garment has been described which is suitable for hospital and other medical patient attire, is comfortable and fashionable for the person wearing the gown, retains maximum personal coverage of the wearer even when partly opened and is cooperative with medical personnel for examination purposes, both in closed and open positions.

The invention has been represented in the drawings in various phases of use. A preferred embodiment has been described with alternate construction suggested. Other changes and modifications may be made, as will be apparent to those skilled in the art, without departing from the inventions defined in the claims.

What is claimed is:

1. A sleeveless examination gown of wrap-around design and essentially unitary construction, said gown having at least three defined areas, including a closed back panel and a first said panel extending continuously from a first lateral boundary of said back panel and a second side panel extending continuously from a second lateral boundary of said back panel, said gown consisting essentially of:

(i) said back panel having a top, right and left side, including a first shoulder flap and a second shoulder flap extending from the top of said back panel and overlapping each shoulder of the body of the wearer, each of said first and second flaps including a frontal edge;

(ii) said first side panel comprising a lateral extension of said right side of the back panel to cover right side and front of the wearer from below said first shoulder of the wearer, said first side panel including a first under-the-shoulder-edge;

(iii) said second side panel comprising a lateral extension of the said left side of the back panel to cover left side and front of the wearer from below said second shoulder of the wearer, said second side panel including a second under-the-shoulder-edge;

(iv) said first shoulder flap of the closed back panel and said first side panel joined to one another in front of the first shoulder of the wearer by a first separable connector means along adjacent edges thereof and said second shoulder flap of the closed back panel and said second side panel joined to one another in front of the second shoulder of the wearer by a second separable connector means along adjacent edges thereof, thereby forming a gown of wrap around design;

(v) said first frontal edge and said first under-the-shoulder-edge being joined by the first separable connector along the front of the gown, from a first throat front of said wearer to an extremity of the wearer's shoulder, thereby providing a sleeveless cap for the first shoulder of said gown, said first separable connector for holding said first shoulder flap of said the closed back panel to said first side panel and for separating said first shoulder flap from said first side panel, on demand, for lowering said first side panel so as to allow for exposure of a selected portion of the front of said wearer while retaining said first shoulder flap on said first shoulder of the wearer;

(vi) said second frontal edge and said second under-the-shoulder-edge being joined by the second separable connector along the front of the gown, from a second throat front of said wearer to an extremity of the wearer's shoulder, thereby providing a sleeveless cap for the second shoulder of said gown, said second separable connector for holding said second shoulder flap of said the closed back panel to said second side panel and for separating said second shoulder flap from said second side panel, on demand, for lowering said second side panel so as to allow for exposure of a selected portion of the front of said wearer while retaining said second shoulder flap on said second shoulder of the wearer;

(vii) a first liner means coupled to said first shoulder flap and in communication with said first shoulder of the wearer, for resisting slippage of said flap from said shoulder when said separable connector means is open;

(viii) a second liner means coupled to said second shoulder flap and in communication with said second shoulder of the wearer, for resisting slippage of said flap from said shoulder when said separable connector means is open; and (ix) means for securing said gown about a waist of said wearer including a first tie means, a second tie means and at least one thread hole located between said back panel and one of said side panels, said first tie means coupled at a first end to said first side panel, said second tie means coupled at a second end to said second side panel, and said thread hole for receiving and passing a tie means for external access to said tie means when said side panels overlap and cover said wearer for providing an external tie for securing said gown about said waist of said wearer.

2. A garment as in claim 1 and in which said first separable connector means is a pressure sensitive connector, capable of being closed in response to application of a first pressure and being opened in response to application of a second pressure.

* * * * *